US005369254A

United States Patent [19]

Kwon

[11] Patent Number: 5,369,254

[45] Date of Patent: Nov. 29, 1994

[54] FOOD WEIGHT DETECTING DEVICE FOR A MICROWAVE OVEN

[75] Inventor: Kyung A. Kwon, Seoul, Rep. of Korea

[73] Assignee: Goldstar Company, Ltd., Seoul, Rep. of Korea

[21] Appl. No.: 180,363

[22] Filed: Jan. 12, 1994

[30] Foreign Application Priority Data

Jan. 12, 1993 [KR] Rep. of Korea ..... 93-340

[51] Int. Cl.[5] ..... H05B 6/68

[52] U.S. Cl. ..... 219/708; 219/518; 177/210 R; 177/145

[58] Field of Search ..... 219/708, 518, 754; 177/210 R, 145

[56] References Cited

U.S. PATENT DOCUMENTS

| | | | |
|---|---|---|---|
| 4,544,042 | 10/1985 | Mikami | 177/25 |
| 4,683,967 | 8/1987 | Hanatani et al. | 219/708 |
| 4,875,533 | 10/1989 | Mihara et al. | 177/144 |
| 4,895,067 | 1/1990 | Ohji et al. | 219/708 |

*Primary Examiner*—Philip H. Leung
*Attorney, Agent, or Firm*—Poms, Smith, Lande & Rose

[57] ABSTRACT

A food weight detecting device for a microwave oven which can detect food weight exactly according to the speed variation of the rotating roller rolling on a base plate having a protrusion formed thereon with predetermined ascending and descending angles. According to the device, the possibility of incorrect weight detection due to such defects as corrosion or secular change of a parallel plate capacitor in the conventional capacitance-detection type device can be eliminated. Thus, reliability of automatic heating control is increased and an inexpensive motor which needs not be heat-resistant can be employed.

16 Claims, 2 Drawing Sheets

FOOD WEIGHT DETECTING DEVICE FOR A MICROWAVE OVEN

BACKGROUND OF THE INVENTION

1. Technical Field

The present invention relates to a food weight detecting device for a microwave oven, and more particularly to a food weight detecting device for a turntable-rotation type microwave oven which can detect food weight accurately according to variations in the angular velocity of the turntable.

2. Prior Art

FIG. 1 shows a conventional food weight detecting device for a microwave oven. The device comprises a synchro motor 1 for providing a rotating force when electric power is supplied, a rotating shaft 2 that rotates a turntable by means of the provided rotating force and moving upward or downward according to the weight of food on the turntable, a weight sensing section 5, having an upper plate 3 and a lower plate 4 facing each other, for sensing the variation of capacitance value as weight information according to the variation of the interval between the upper plate 3 and the lower plate 4 due to upward or downward movement of the rotating shaft 2, an LC oscillating section 6 for generating a frequency signal which varies corresponding to the varied capacitance value, a buffer section 7 for shaping the generated frequency signal to a rectangular wave, and a microcomputer 8 for receiving the shaped rectangular wave and evaluating the weight of food on the turntable according to the frequency of the rectangular wave.

The conventional device having the above-described construction is operated as follows. First, if a user applies electric power to the microwave oven to heat food, the rotating shaft 2 is rotated by the synchro motor 1 and the turntable mounted on the rotating shaft 2 is rotated. In this case, the rotating shaft 2 moves upward or downward according to the weight of food being heated on the turntable, so that the weight sensing section 5 senses the weight of food on the turntable.

That is, if the upper plate 3, having an appropriate elastic force, is forced by the upward or downward movement of the rotating shaft 2, the interval between the upper plate 3 and the lower plate 4 will vary according to the upward or downward movement of the upper plate 3, thereby the capacitance value provided from the weight sensing section 5 composed of the upper plate 3 and the lower plate 4 will also vary. The varied capacitance value is supplied to the LC oscillating section 6 and an oscillating frequency signal, which varies according to the variation of the capacitance value, is outputted from the LC oscillating section 6. The outputted frequency signal is shaped to a rectangular wave by the buffer 7 and then is supplied to the microcomputer 8, so that the microcomputer 8 evaluates the weight of food on the turntable according to the frequency of the rectangular wave.

However, in the above-mentioned food weight detecting device, physical deformation is apt to be produced by defects such as the scale and/or the secular change of the material quality of the upper plate 3 and the lower plate 4, thereby there is a great possibility that the precise change of the capacitance value may not be detected.

Further, there are several disadvantages that the synchro motor 1 must be disposed at the center portion under the turntable since the rotating shaft 2 is disposed at the center portion of the turntable, and that microwaves will leak through the rotating shaft penetrating pore formed at the lower part of a heating cavity.

SUMMARY OF THE INVENTION

The object of the present invention is to provide a reliable food weight detecting device for a microwave oven which can eliminate the possibility of incorrectly detecting food weight due to such defects as the secular change of the material quality of the device.

Another object of the present invention is to provide a food weight detecting device for a microwave oven which can employ an inexpensive motor, which need not be heat-resistant since it can be disposed spaced apart from the heating cavity, as well as eliminating the possibility of leaking microwaves.

To achieve the above objects, the present invention provides a food weight detecting device for a microwave oven, comprising:

weight sensing means for sensing the variation of the rotation speed of a rotating ring as a weight information of food, said weight sensing means including a base plate having a protrusion formed thereon with predetermined ascending and descending angles, said rotating ring disposed under a turntable to rotate together with said turntable, and at least one roller incorporated with said rotating ring to roll on said base plate;

driving means for driving said weight sensing means; and weight evaluating means for evaluating the weight of food corresponding to the variation of the rotation speed of said rotating ring provided from said weight sensing means.

Preferably, Said driving means may be composed of a synchro motor for supplying a rotating force, a second rotating shaft driven by said synchro motor, a first rotating shaft for supporting and driving the turntable, and a belt engaged between said first and second rotating shafts to deliver the rotating force from said second rotating shaft to said first rotating shaft.

BRIEF DESCRIPTION OF THE DRAWINGS

The above objects and other features and advantages of the present invention will be apparent from the following description with reference to the accompanying drawings, in which.

DETAILED DESCRIPTION OF THE PREFERRED EMBODIMENTS

Figure 1:
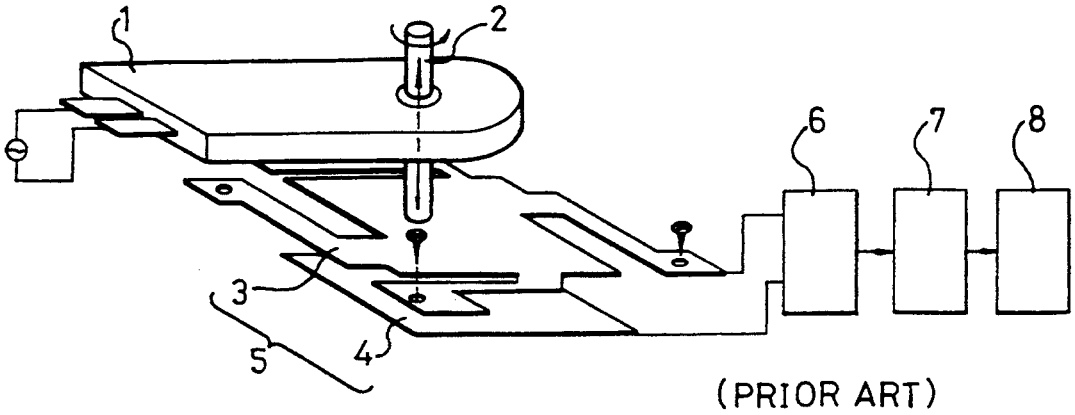
FIG. 1 shows the construction of a conventional weight detecting device utilizing a capacitance change detecting method.
Figure 2:
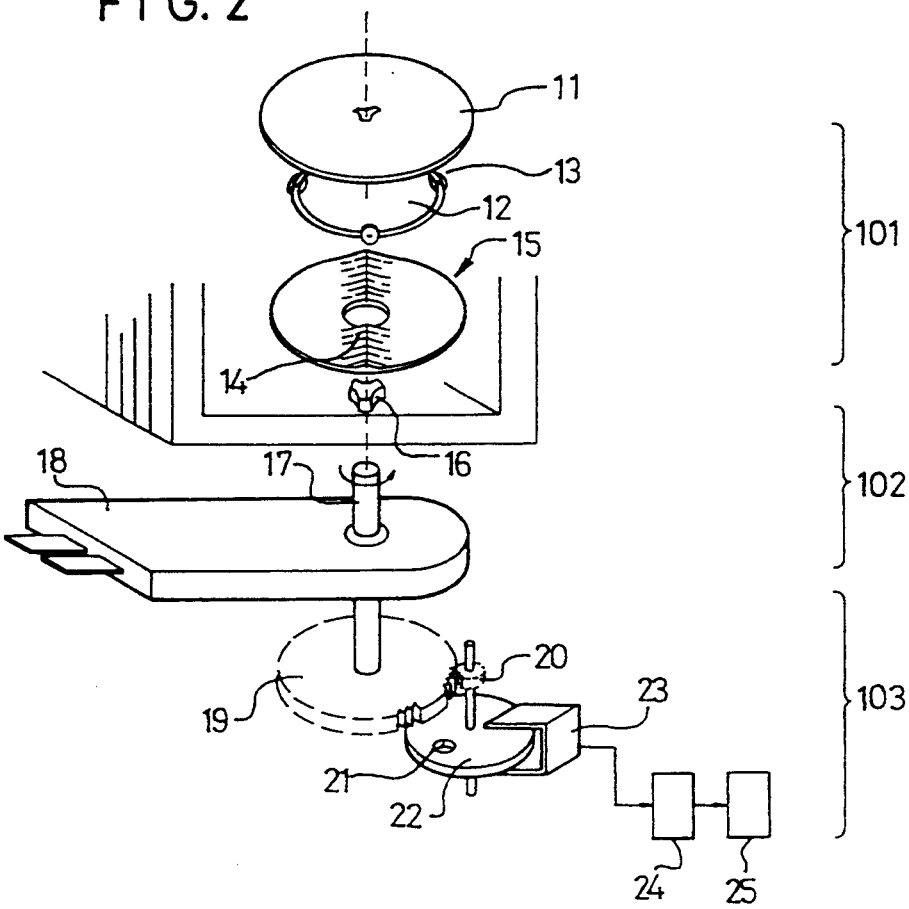
FIG. 2 shows the schematic construction of the weight detecting device according to one embodiment of the present invention.

FIG. 2 shows a food weight detecting device for a microwave oven according to one embodiment of the present invention. The present device comprises a weight sensing section 101 for sensing the variation of the rotation speed of a rotating ring 12 as a weight information of food, a driving section 102 for driving said weight sensing section 101, and a weight evaluating section 103 for evaluating the weight of food by utilizing the variation of the rotation speed provided from the weight sensing section 101. The weight sensing section 101 includes a base plate 15 on which a protrusion 14 having a predetermined ascending angle $\alpha$ and a predetermined descending angle $-\alpha$ is formed, a rotating ring 12 disposed under the turntable 11 on which food to be heated is put and rotating together with the turntable 11, and rollers 13 incorporated with the rotating ring 12 to roll on the base plate 15.

The driving section 102 includes a rotating shaft 17 for transmitting the rotating force for the turntable to be rotated, and a synchro motor 18 for driving the rotating shaft 17.

The weight evaluating section 103 includes a base gear 19 disposed at the lower part of the rotating shaft 17 to be rotated by the rotating shaft 17, a spindle gear 20 engaged with the basis gear 19, a spindle 22 having a rotation detecting pore 21 and connected to the spindle gear 20 to rotate together with the spindle gear 20, a speed detector 23 for outputting a rotation speed detecting signal corresponding to the rotation of the spindle 22, a buffer 24 for shaping the detected rotation speed to a rectangular wave, and a microcomputer 25 for evaluating the weight of food on the turntable 11 according to the shaped rectangular wave signal.

The weight detecting device of the present invention as constructed above is operated as follows:

First, if electric power is applied, the rotating shaft 17 is rotated by the synchro motor 18, and the rotating force is delivered through a coupler 16, thereby the turntable 11 mounted on the rotating ring 12 rotates with the food being cooked. In this case, the rollers 13 incorporated with the rotating ring 12 roll on the base plate 15, and the speed of the rollers 13 on the plane part of the base plate 15 is different from that on the protrusion 14 of the base plate 15. That is, the speed of the rollers 13 is constant when the rollers 13 pass the plane part, while the speed varies when the rollers 13 pass the protrusion 14 due to the gravity applied to the rollers 13. In this case, the gravity corresponds to the weight of the food, the turntable, and the roller, wherein the weight of the turntable and the rollers is constant, while the weight of the food is variable.

Figure 4:
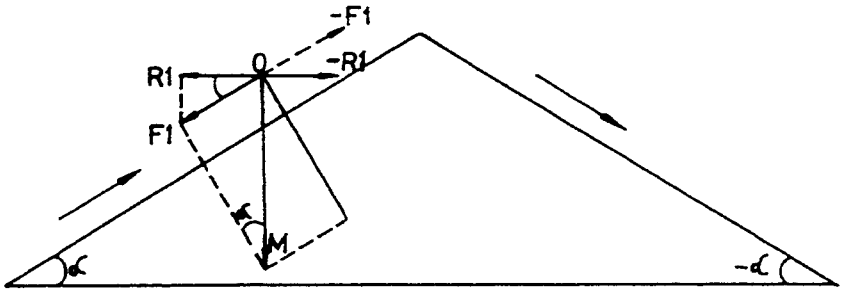
FIG. 4 is a force diagram explaining the weight detecting principle according to the present invention.

FIG. 4 is a diagram showing the relation between the gravity applied on the roller 13 and the rotating force of the roller 13 by the rotating shaft 17 while the roller 13 passes on the protrusion 14. In the following description, the rotating force of the roller 13 is put as "R" and the gravity applied on the roller 13 is put as "M". As shown in FIG. 4, a descending force of $F1=M \sin \alpha$ is applied on the roller 13 while the roller 13 ascends the protrusion 14. The descending force F1 is applied to disturb the rotation of the roller, and the component of the descending force F1 which is inverse to the rotating direction of the roller is $$R1=F1 \cos \alpha=M \sin \alpha \cos \alpha$$

Therefore, while the roller 13 ascends the protrusion 14, the resultant rotating force is $$R_T=R-M \sin \alpha \cos \alpha$$

On the contrary, while the roller 13 descends the protrusion 14, the descending force by the gravity increases the rotating force of the roller 13, and the resultant rotating force is $$R_T=R+M \sin \alpha \cos \alpha$$

Meanwhile, the base gear 19 connected to the lower part of the rotating shaft 17 rotates at the same speed as that of the rotating ring 12. According to the rotation of the base gear 19, the spindle gear 20 engaged with the base gear 19 and the spindle 22 connected to the lower part of the spindle gear 20 rotate. The speed detector 23 can be embodied by an optical interrupter to output an optical pulse interrupted through the detecting pore 21 formed at the spindle 22 as a speed detecting signal. The speed detecting signal outputted from the speed detector 23 is shaped to a rectangular wave by the buffer 24, and then is supplied to the microcomputer 25. The microcomputer 25 senses the variation of the rotation speed according to the rectangular wave to evaluate the weight of food on the turntable.

Figure 3:
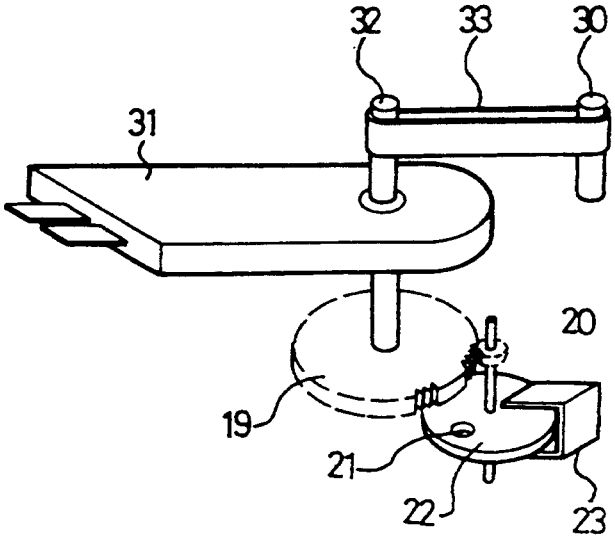
FIG. 3 shows the schematic construction of the weight detecting device according to another embodiment of the present invention.

FIG. 3 shows a part of the food weight detecting device for a microwave oven according to another embodiment of the present invention. The driving section of the device is composed of a synchro motor 31 for supplying rotating force, a second rotating shaft 32 driven by the synchro motor 31, a first rotating shaft 30 supporting and driving the turntable of the microwave oven, and a belt 33 engaged between the first rotating shaft 30 and the second rotating shaft 32. In the embodiment as constructed above, if electric power is applied, the second rotating shaft 32 is rotated by the synchro motor 31, the rotating force of the second rotating shaft 32 is delivered to the first rotating shaft 30 through the belt 33, and thus the turntable on which food to be heated is put is also rotated. The weight evaluating section evaluates the weight of the food from the rotating speed of the second rotating shaft because the base gear 19 is connected to the lower part of the second rotating shaft 32. Therefore, according to the above-mentioned construction, an inexpensive motor can be used because the motor can be spaced apart from the heating chamber and thus neet not to be heat-resistant.

Meanwhile, as still another embodiment of the present invention, the spindle 22 may be a magnetic spindle 22 and the speed detector 23 may be a magnetic sensor. In this case, the speed detector 23 generates a rotation speed detecting signal corresponding to the variation of the magnetic field through the pore 21 according to the rotation of the spindle.

From the foregoing, according to the present invention, the possibility of an incorrect weight detection due to such defects as corrosion or secular change of a parallel plate capacitor in the conventional capacitance-detection type device can be eliminated. Thus, the present invention provides the advantages that reliability of automatic heating control is increased, and an inexpensive motor which needs not be heat-resistant can be employed.

While the present invention has been described and illustrated herein with reference to the preferred embodiment thereof, it will be understood by those skilled in the art that various changes in form and details may be made therein without departing from the spirit and scope of the invention.

What is claimed is:

1. A food weight detecting device for a microwave oven, comprising:

a microwave oven turntable on which food is to be placed;

a rotating ring disposed under said turntable and rotatable therewith;

weight sensing means for sensing variation of rotation speed of said rotating ring as weight information of the food, said weight sensing means including a base plate having a protrusion formed thereon with predetermined ascending and descending angles, and at least one roller incorporated with said rotating ring to roll on said base plate;

2. A food weight detecting device as claimed in claim 1, wherein said rotating means includes a rotating shaft for transmitting a rotating force to rotate said turntable, and a synchro motor for driving said rotating shaft.

3. A food weight detecting device as claimed in claim 1, wherein said rotating means includes a synchro motor for supplying a rotating force, a second rotating shaft driven by said synchro motor, a first rotating shaft supporting and driving said turntable, and a belt engaged between said first rotating shaft and said second rotating shaft to deliver the rotating force from said second rotating shaft to said first rotating shaft.

4. A food weight detecting device as claimed in claim 1, wherein said weight evaluating means includes a base gear rotated by said rotating means, a spindle gear engaged with said base gear, a spindle having a rotation detecting pore and connected to said spindle gear to rotate together with said spindle gear, a speed detector for providing a rotation speed detecting signal corresponding to the rotation of said spindle, a buffer for shaping said rotation speed detecting signal to a rectangular wave, and a microcomputer for evaluating the weight of the food on said turntable according to said shaped rectangular wave.

5. A food weight detecting device as claimed in claim 4, wherein said speed detector is a magnetic sensor and said spindle is magnetized.

6. A food weighing device for a microwave oven, said device comprising:

a rotatable turntable for supporting a quantity of food in a microwave oven;

a roller;

a rolling surface having a bump with ascending and descending slopes;

wherein one of said roller or rolling surface is coupled to and beneath said turntable and is rotatable with said turntable and on the other of said roller or rolling surface;

sensing means for sensing variations of the rotational speed of said turntable supporting the quantity of food as one said roller and said rolling surface rolls on the other; and determining means for determining, from the rotational speed variations sensed by said sensing means, the weight of the quantity of food.

7. A device as claimed in claim 6, wherein said roller is secured to said turntable and rolls on said rolling surface therebeneath.

8. A device as claimed in claim 6, further comprising a rotatable ring disposed under and rotatable with said turntable, said roller being integral with said rotatable ring.

9. A device as claimed in claim 6, further comprising a rotatable shaft secured to said turntable and motor means for rotating said shaft and thereby rotting said turntable.

10. A device as claimed in claim 9, wherein said determining means includes a base gear rotated by said motor means, spindle gear engaged with said base gear, a spindle having a rotation detecting opening and rotatable with said spindle gear, speed detector means for generating a rotational speed detecting signal corresponding to the rotational speed of said rotation detecting opening, buffer means for shaping the rotational speed detecting signal into a rectangular waveform, and microcomputer means for determining from the rectangular waveform the weight of the quantity of food.

11. A device as claimed in claim 10, wherein said speed detection means is a magnetic sensor and said spindle is magnetized.

12. A device as claimed in claim 9, wherein said rotatable shaft defines a first rotatable shaft, and further comprising a second rotatable shaft rotated by said motor means and delivering means for delivering rotating force from said second rotatable shaft to said first rotatable shaft.

13. A device as claimed in claim 12, wherein said delivering means includes a belt engaged between said first and second rotatable shafts.

14. A device as claimed in claim 6, further comprising a rotating shaft operatively secured to said turntable, a coupler and synchro motor means for rotating said shaft through said coupler.

15. A device as claimed in claim 6, wherein said rolling surface includes a flat portion, and wherein the speeds of said roller on said ascending and descending slopes are different than on said flat portion due at lest in part to the weight of the quantity of food.

16. A device as claimed in claim 6, wherein said sensing means includes an optical interpreter.

* * * * *